United States Patent [19]

Okabe

[11] 4,013,159

[45] Mar. 22, 1977

[54] PRINTER HAVING A LIMITED MOVEMENT PLATEN AND/OR PRINTING HEAD AND INDEPENDENT SUPPORTS THEREFOR

[75] Inventor: Katsuhiko Okabe, Tokorozawa, Japan

[73] Assignee: Copal Company Limited, Tokyo, Japan

[22] Filed: May 21, 1975

[21] Appl. No.: 579,425

[30] Foreign Application Priority Data

May 30, 1974 Japan ..... 49-60270
May 30, 1974 Japan ..... 49-60271

[52] U.S. Cl. ..... 197/1 R; 197/127 R; 197/148

[51] Int. Cl.[2] ..... B41J 3/20; B41J 13/03

[58] Field of Search ..... 197/1 R, 114 R, 127 R, 197/133 R, 144, 148; 219/216; 346/76 R

[56] References Cited

UNITED STATES PATENTS

| | | | |
|---|---|---|---|
| 2,985,135 | 3/1961 | Hickerson | 197/1 R X |
| 3,754,278 | 8/1973 | Borden | 346/76 R |
| 3,787,886 | 1/1974 | McCrady | 346/76 R |
| 3,810,192 | 5/1974 | Okabe | 346/76 R X |
| 3,828,911 | 8/1974 | Soderstrom | 197/114 R |
| 3,837,461 | 9/1974 | Waibel | 197/148 X |
| 3,848,720 | 11/1974 | Carlsen | 197/1 R |

*Primary Examiner*—Edgar S. Burr
*Assistant Examiner*—Paul T. Sewell
*Attorney, Agent, or Firm*—Oblon, Fisher, Spivak, McClelland & Maier

[57] ABSTRACT

A printer having a frame, a printing head and a platen, either one of the head and the platen is fixedly secured to the frame while the other is movably mounted on the frame by movable supports so that they are moved relatively toward and away from each other for the printing operation of a paper held therebetween when abutted against each other. The movable supports comprises a pair of supporting members each movably mounting other of the head and the platen independently from each other. Each of the supporting member is biased by a spring so as to urge the other of the head and the platen against the one of the head and the platen independently from each other. Thus, the parallel relationship between the head and the platen when abutted against each other for the printing operation is insured.

5 Claims, 6 Drawing Figures

PRINTER HAVING A LIMITED MOVEMENT PLATEN AND/OR PRINTING HEAD AND INDEPENDENT SUPPORTS THEREFOR

BACKGROUND OF THE INVENTION

The present invention relates to a printer, particularly, to a thermal printer for printing a line of characters on a paper each time of operation thereof.

Heretofore, a thermal printer has been developed in which an electromagnetic plunger is utilized for actuating head platen separating means and paper feeding means each time the printing operation of a line of characters has been completed. However, when the plunger is utilized, the actuating mechanism relating to the plunger must be arranged in the longitudinal direction of the plunger thereby resulting necessarily in a large size of the printer, which is serious disadvantages in a printer which is to be characterized by its compact size. Further, the mechanical impact noise of a plunger is very high thereby deteriorating the performance of a printer in which silent operation is required.

The present invention aims at avoiding the above described disadvantages of the prior art printer.

SUMMARY OF THE INVENTION

An object of the present invention is to provide a novel and useful printer which avoids the above described disadvantages of the prior art printer.

The other object is to provide a novel and useful printer of the type described above which is compact in size and in which noise in the operation is extremely reduced and yet accurate operation is insured.

A further object is to provide a novel and useful printer of the type described above in which the parallel relationship between the printing head and the platen is insured when they are abutted for the printing operation thereby insuring high quality of the printed characters.

A still further object is to provide a novel and useful printer of the type described above in which a driving motor is utilized for actuating the head-platen separating means and the paper feeding means wherein accurate operation of the head-platen separating means and the paper feeding means is insured while the time period for each cycle of the printing operation is kept to a minimum.

The above object is achieved in accordance with the characteristic feature of the present invention by the provision of a printer having a frame, a printing head and a platen, either one of the printing head and the platen being fixedly secured to the frame while the other is movably mounted on the frame by movable supporting means so as to move toward and away from the one of the printing head and the platen for the printing operation on a sheet held therebetween, the printer being characterized in that the movable supporting means comprises a pair of supporting members each movably mounting the other of the printing head and the platen on the frame independently from each other at positions spaced from each other and each of the supporting members is biased by a spring independently from each other so as to urge the other of the printing head and the platen toward the one of the printing head and the platen thereby insuring parallel relationship between the printing head and the platen when the printing head and the platen are abutted against each other for the printing operation on a sheet of paper held therebetween.

The platen may be arranged so as to be rotated about its longitudinal axis by a limited range of rotation thereby insuring parallel relationship in the direction perpendicular to the longitudinal axis between the printing head and the platen when abutted against each other to further improve the quality of printing.

In accordance with another feature of the present invention, a motor is utilized for actuating the head-platen separating means for separating the head and the platen which are normally urged to abut against each other for the printing operation and the paper feeding means for feeding a paper after the head and the platen are separated from each other through a single revolution clutch adapted to rotate by one revolution each time it is actuated, and the motor is energized by a control circuit simultaneously with the issuance of a printing demand in the printer so that the speed of the motor is increased to its normal constant speed during the time the printing operation is being effected and, upon completion of the printing operation, a printing completion signal is issued so as to actuate the clutch through an electromagnetic clutch magnet to which the signal is applied for energization of the magnet thereby actuating the head-platen separating means and the paper feeding means in timed sequence after the speed of the motor reaches its normal constant speed so that accurate operation of the head-platen separating means and the paper feeding means is insured while the time period for one cycle of the printing operation is kept minimum.

The head-platen separating means and the paper feeding means are actuated through cam means each mounted on a common shaft adapted to be rotated by one revolution each time the clutch is actuated by the magnet, thereby insuring the exact timed relationship in the sequence of operation of the head-platen separating means and the paper feeding means.

Since a motor has a very high speed and suitable reduction device must be provided for actuating the head-platen separating means and the paper feeding means by the motor, the orientation and location of the motor may be optionally selected depending upon the design of the printer due to the provision of the reduction device thereby permitting the size of the printer to be made to the minimum. The motor has very low noise in comparison with the plunger thereby reducing the noise in the operation of the printer.

DETAILED DESCRIPTION OF THE PREFERRED EMBODIMENTS

Figure 1:
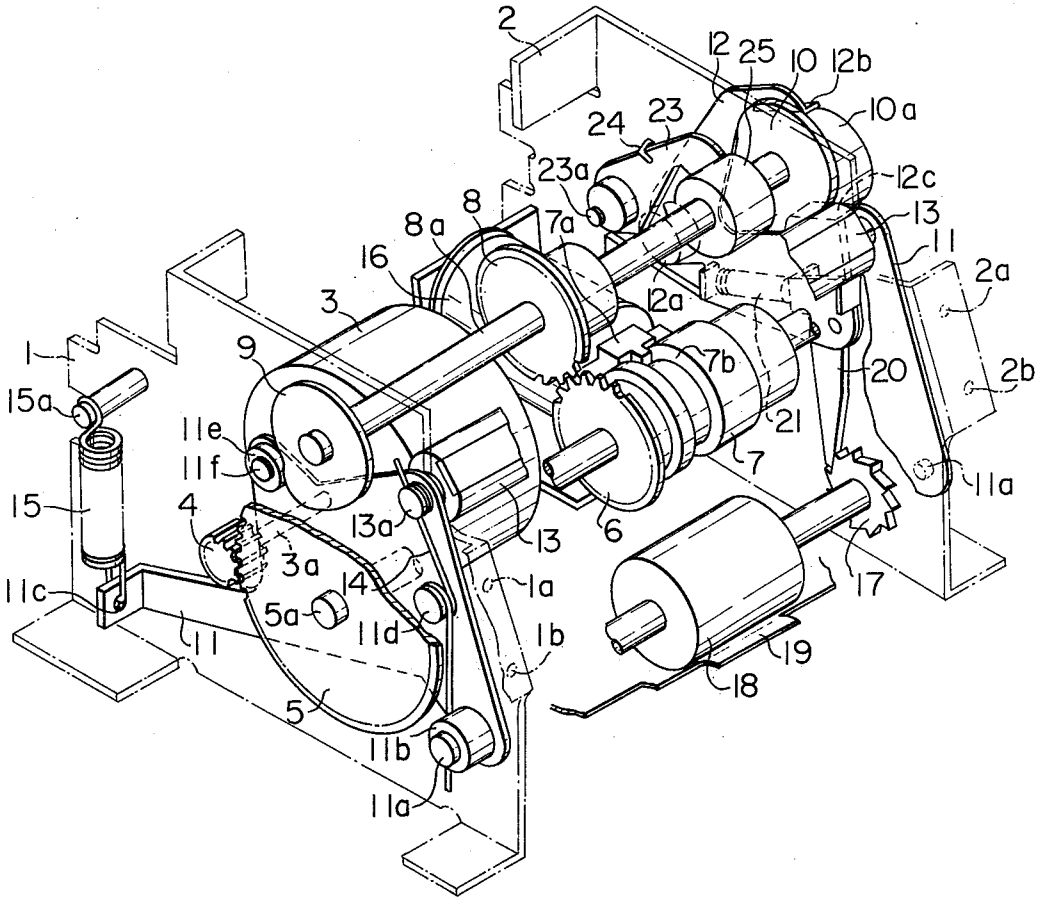
FIG. 1 is a schematic general perspective view showing the main portions of an embodiment of the printer constructed in accordance with the present invention.
Figure 2:
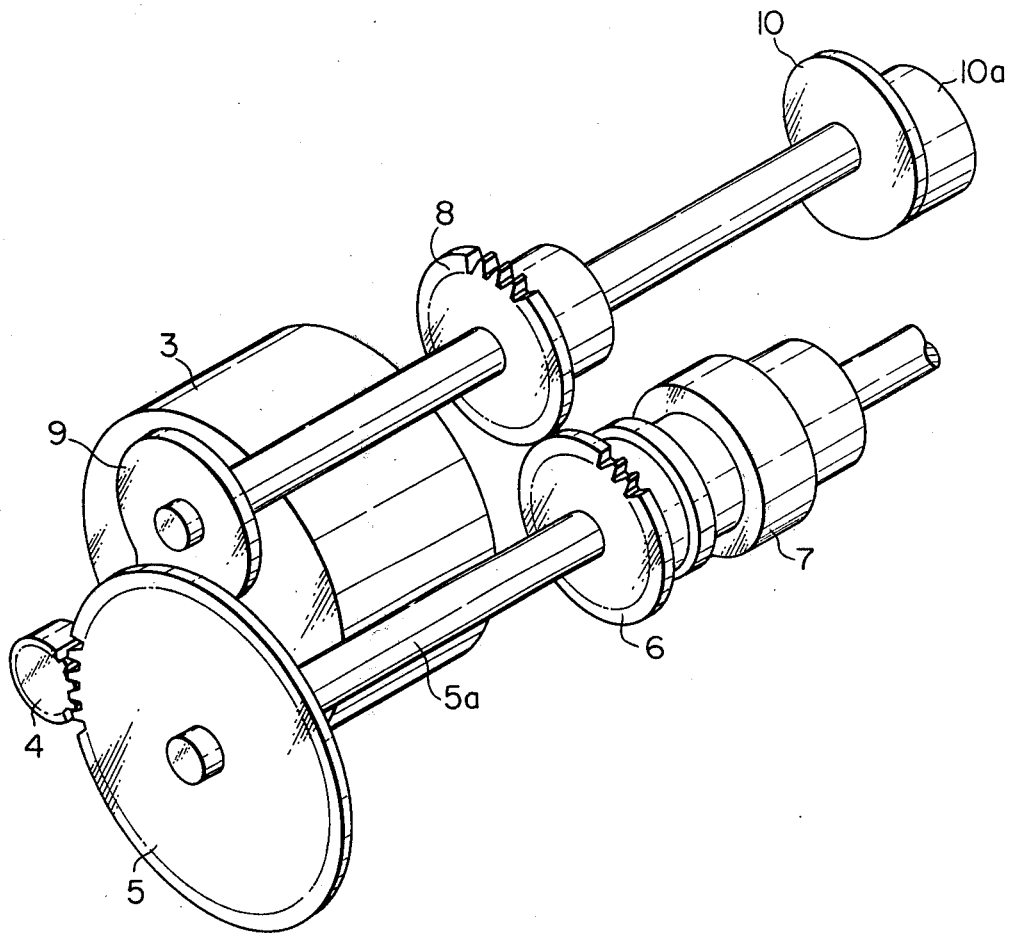
FIG. 2 is a fragmentary perspective view showing the arrangement of the single revolution clutch and cam means of the head-platen separating means and the paper feeding means.
Figure 3:
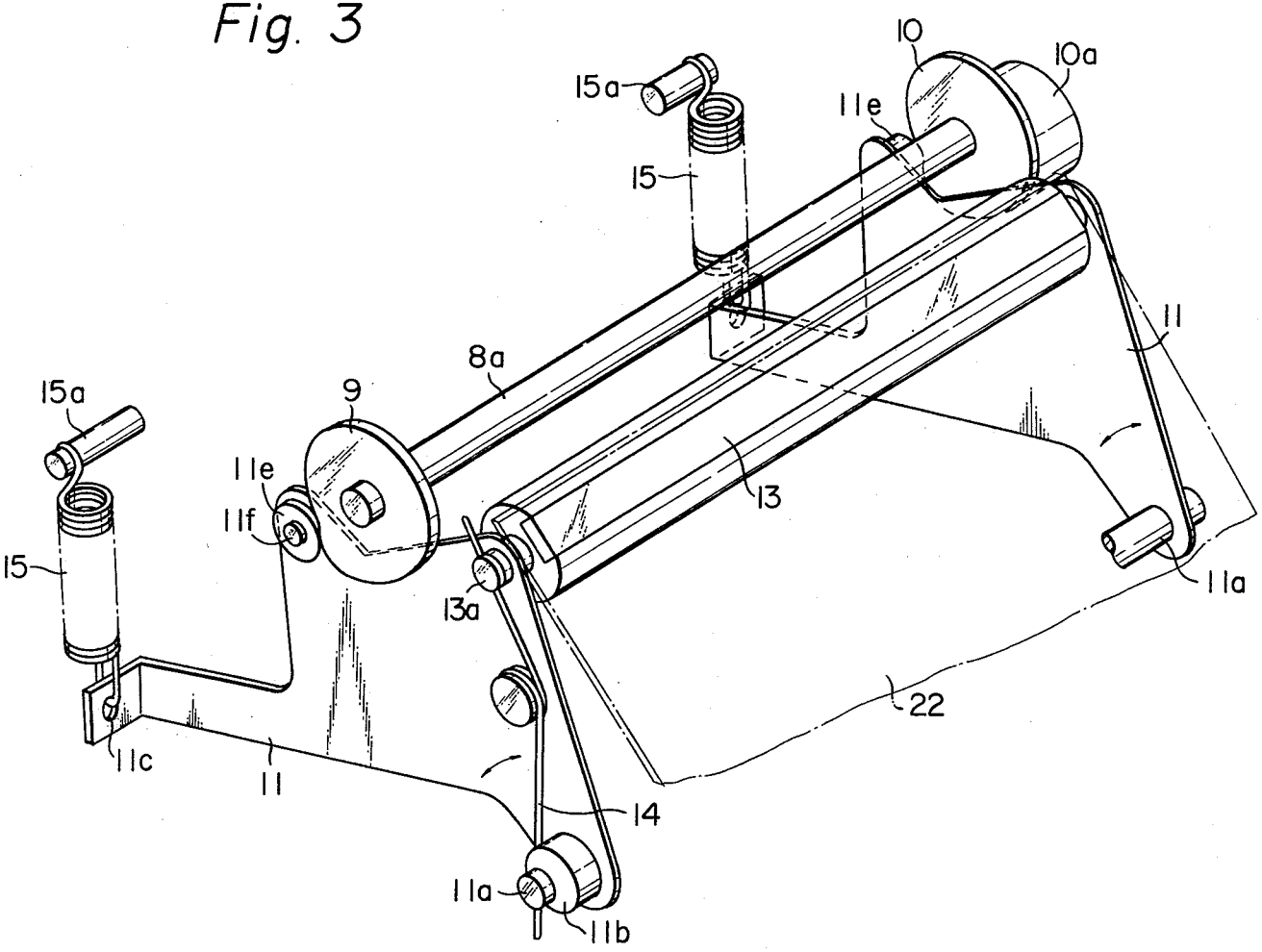
FIG. 3 is a fragmentary perspective view showing the construction of the platen supporting members and the platen.

The body of the printer comprises frame members 1, 2 which are secured to a base (not shown). A motor 3 is secured inside the frame member 1 and the motor shaft 3*a* of the motor 3 extends outwardly from the frame member 1. A pinion 4 secured to the outer end of the shaft 3*a* meshes with a gear 5 fixedly mounted on a shaft 5*a* which is rotatably supported by the frame members 1, 2, so that the shaft 5*a* is rotated in the clockwise direction as seen in FIG. 1 when the motor 3 is energized. A single revolution clutch 7 is mounted on the shaft 5*a* between the frame members 1, 2 and the driven member of the clutch 7 has a gear 6 secured thereto. The clutch 7 has a coiled spring (not shown) which is tightly wound around the shaft 5*a* so that, when the spring is in the free state, the tightly engages the shaft 5*a* so as to rotate the driven member of the clutch 7 together with the gear 6, but, when a clutch pawl 7*a* adapted to be fitted in the groove 7*b* of the driven member arrests the rotation of the driven member by the engagement thereof with a projection (not shown) in the groove 7*b*, the coil spring is loosened from the shaft 5*a* so that the driven member is kept in non-rotating state even through the shaft 5*a* is rotating. When the clutch pawl 7*a* is disengaged from the projection in the groove 7*b* as by the energization of an electromagnetic clutch magnet 16 as described later, the driven member is freed to tighten the coil spring around the shaft 5*a* so that the driven member is rotated together with the coil spring tightly engaged with the rotating shaft 5*a* until the clutch pawl 7*a* which has been freed by the deenergization of the magnet again engages with the projection in the groove 7*b*, at which time the driven member is arrested so as to loosen the coil spring from the shaft 5*a* so that the driven member is held in non-rotating state after one complete revolution each time the clutch pawl 7*a* is actuated by the magnet 16.

A gear 8 having the same shape as the gear 6 is secured to a shaft 8*a* rotatably supported by the frame members 1, 2 and the gear 8 meshes with the gear 6 so that the shaft 8*a* is rotated in the counterclockwise direction by one revolution each time the clutch 7 is actuated.

The shaft 8*a* has a pair of cams 9, 10 and a cam 10*a* secured thereto at positions as shown in FIGS. 1 to 4. The cams 9, 10 are of the same shape and the same angular orientation and serve to actuate platen supporting levers 11, 11 for separating the platen 13 from the printing head 22 as described later. The cam 10*a* serves to actuate the paper feeding lever 12 for driving the paper feeding ratchet 17 integral with the paper feeding roller 18 so that the paper (not shown) held between the roller 18 and the pressure spring 19 is fed after the head 22 and the platen 13 are separated from each other as described later.

A further cam 25 is secured to the shaft 8*a* for aiding the positive disengagement of the coil spring of the clutch 7 from the shaft 5*a*. The cam 25 cooperates with a lever 23 pivotally supported by a shaft 23*a* on the frame member 2 and urged by a spring 24 toward the cam 25. The configuration and the angular orientation of the cam 25 is so determined that, when the shaft 8*a* commences its rotation, the lever 23 is urged upwardly by the cam 25 and, at the end of one revolution of the shaft 8*a*, the lever 23 is moved slidingly downwardly along the recessed portion of the cam 25 so that the shaft 8*a* is urged in the direction of rotation thereof by the lever 23 engaging the recessed portion of the cam 25. Therefore, the gear 6 meshing with the gear 8 is also urged in the direction of rotation thereof together with the driven member of the clutch at the end of one revolution thereof thereby positively loosening the coil spring from the shaft 5*a*.

A pair of platen supporting levers 11, 11 of a symmetrical configuration are pivotally supported by shafts 11*a*, 11*a* at the respective outer sides of the frame members 1, 2 and the platen 13 is rotatably supported by a shaft 13*a* integral thereto on the respective levers 11, 11. A peripheral groove is formed adjacent to one end of the shaft 13*a* projecting outwardly of the frame member 1. A spring 14 is supported by a pin 11*d* on the lever 11 and one end of the spring 14 is fitted in the peripheral groove while the other end thereof is supported by a stopper 11*b* secured to the lever 11 by a pin 11*a* so that the range of rotation of the platen 13 is limited by the spring 14 so as to insure parallel relationship between the platen and the printing head 22 when abutted against each other as described later.

The levers 11, 11 have elongated arms, respectively, and the bent portion formed at each of the arms has a hole 11*c*. One end of a spring 15 is held by the hole 11*c* of each of the arms of the levers 11, 11 and the other end is held by a pin 15*a* secured to each of the frame members 1, 2 so that the levers 11, 11 are urged in the clockwise direction by the respective springs 15, 15 independently from each other.

The printing head 22 preferably of the type of a thermal printing head is secured to the frame members 1, 2 by set screws which are threaded into tapped holes 1*a*, 1*b*, 2*a*, 2*b* of the frame members 1, 2, so that the platen 13 is normally urged against the printing head 22 by the levers 11, 11 independently from each other thereby insuring parallel relationship therebetween.

The roller 11*e* rotatably supported by a pin 11*f* on each of the levers 11, 11 is adapted to engage with the respective cams 9, 10 so that the levers 11, 11 are swung in the counterclockwise direction by the cams 9, 10 after the rotation of the shaft 8*a* is commenced, thereby separating the platen 13 from the printing head 22 during a part of one revolution of shaft 8*a*. When the shaft 8*a* has completed its one revolution, however, the cams 9, 10 are disengaged from the rollers 11*e* with the platen 13 held abutted against the head 22 so that the platen 13 is urged against the head 22 solely by the action of the pair of springs 15 urging the levers 11, 11 without being affected by the action of the cams 9, 10 thereby insuring the parallel relationship between the platen 13 and the head 22 by virtue of the independent action of the respective levers 11, 11 effected by the springs 15.

The printing operation is effected on a paper by a printing demand issued by a printing demanding circuit when the platen 13 and the head 22 are urged toward each other with the paper sandwiched therebetween as described later.

Figure 4:
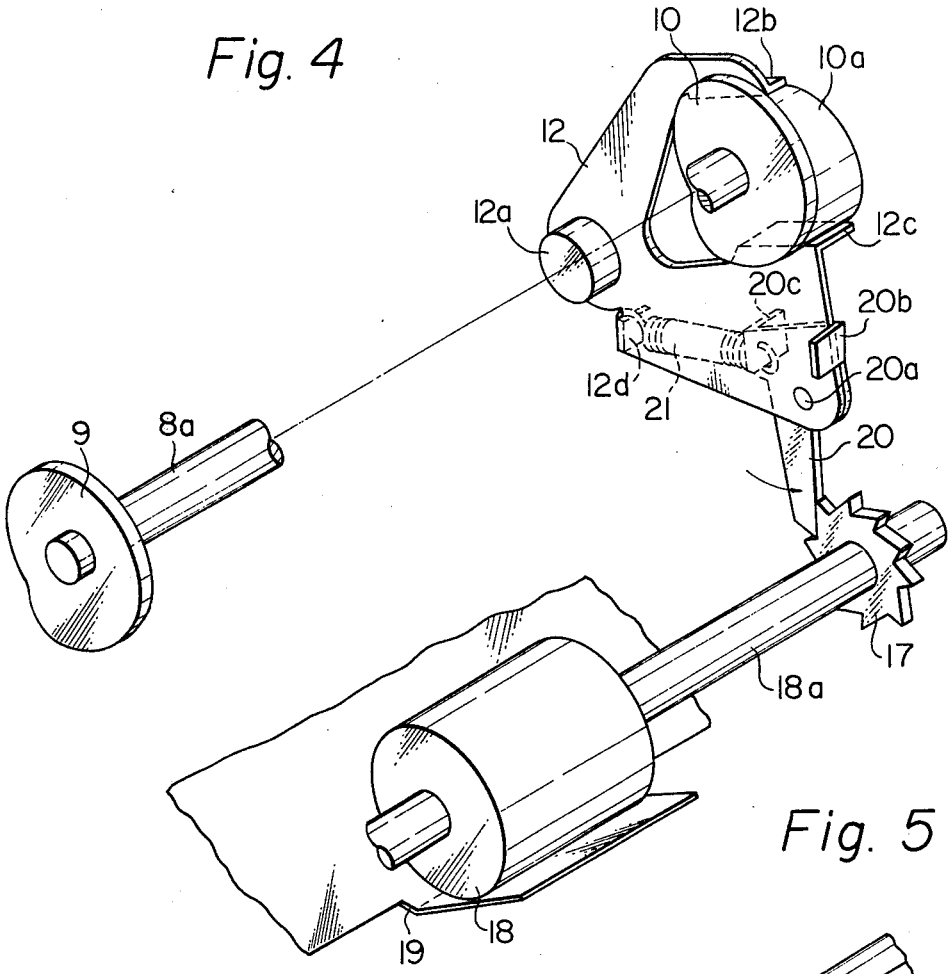
FIG. 4 is a fragmentary perspective view showing the relationship between the paper feeding lever and the paper feeding roller.

Referring now to FIGS. 1 and 4, the paper feeding lever 12 is pivotally supported by a shaft 12*a* on the frame member 2 and it has bifurcated arms having at their ends spaced parallel bent portions 12*b*, 12*c*, respectively, and the cam 10*a* is snugly fitted between the bent portions 12*b*, 12*c* of the lever 12, so that the lever 12 is given one reciprocal swinging movement when the cam 10*a* is rotated one revolution by the action of the clutch 7.

A paper feeding pawl 20 is pivoted by a pin 20*a* on the lever 12 and the tip of the pawl 20 is adapted to engage with a paper feeding ratchet 17 secure to a shaft 18*a* to which the paper feeding roller 18 cooperating with a paper feeding pressure plate 19 is fixedly secured, the shaft 18*a* being rotatably supported by the frame members 1, 2.

A spring 21 is supported at its one end to the bent portion 20*c* of the pawl 20 while the other end is supported by a bent portion 12*d* formed in the lever 12 so as to urge the pawl in the counter-clockwise direction to insure the engagement of the tip of the pawl 20 with the ratchet 17. In order to prevent the excessive counterclockwise rotation of the pawl 20 prohibiting the engagement thereof with the ratchet 17 by the action of the spring 21, a bent portion 20*b* is formed in the pawl 20 which is adapted to abut the side edge of the lever 12 for limiting the range of counterclockwise rotation of the pawl 20. Thus, when the lever 12 is given one reciprocal swinging by the one revolution of the shaft 8*a*, the pawl 20 is reciprocated so as to advance the ratchet 17 by one tooth thereby rotating the paper feeding roller 18 for feeding the paper held between the roller 18 and the pressure plate 19 an appropriate distance.

The angular orientation of the cam 10*a* with respect to the cams 9, 10 is so determined that the paper feeding roller 18 and, hence, the lever 12 is actuated by the cam 10*a* after the platen 13 has been separated from the head 22 by the action of the platen supporting levers 11 caused by the cams 9, 10. It is apparent that an appropriate detent means may be provided so as to prevent reverse rotation of the ratchet 17.

Figure 6:
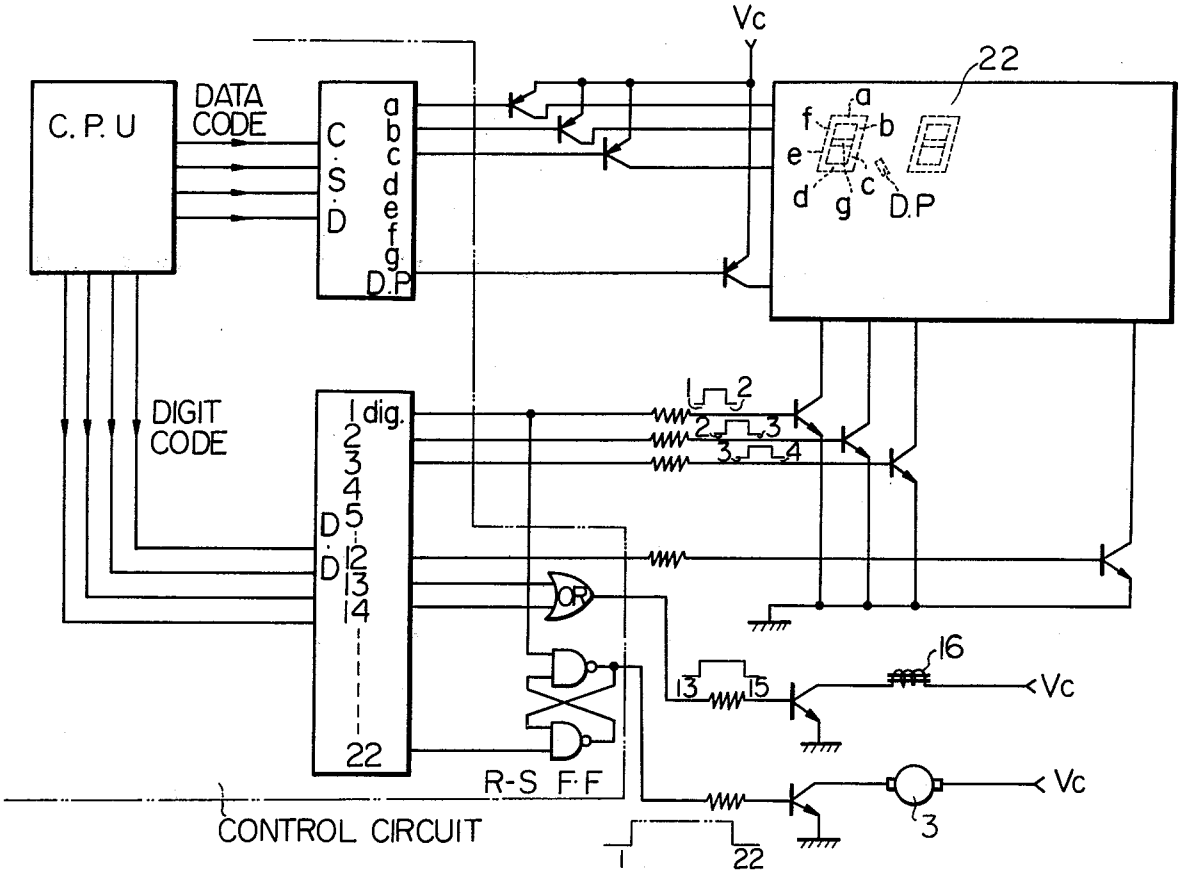

In the printer constructed as described above, a control circuit for controlling the energization of the motor 3 and the clutch magnet 16 is provided in conjunction with the printing demanding circuit of the printer. FIG. 6 shows a conventional control circuit suitable for controlling the motor 3 and the clutch magnet 16 which elements are known per se so that a detailed description thereof is not necessary. Briefly describing the circuit in conjunction with FIG. 6, the control circuit comprises a central processor unit C.P.U. adapted to serially issue data codes of characters or numerals to be printed as well as digit codes of the figure or digit number of 12, for example. A character segment decoder C.S.D. is adapted to convert the data codes to segment character codes, and a digit decoder D.D. is adapted to convert the digit codes to figure or digit signals while a flip-flop R-S F.F has inputs connected to the 1 and 22 digit signals of the digit decoder D.D. An OR gate OR has its inputs connected to digit signals 13, 14 and an output connected to the clutch magnet 16 as shown. The motor 8 is connected to the output of the flip-flop R-S F.F through a transistor so that it is driven by the issuance of the digit signal 1 and stopped by the issuance of the digit signal 22, while the clutch magnet 16 is energized by the issuance of the digit signal 13 or 14 so as to actuate the clutch 7. The outputs *a, b* - - - *g*, D. P. of the character sigment decoder C.S.D. are connected to the printing head 22 so as to actuate selected segments, *a, b, c, g*, D.P. and form a selected character, while the outputs of the 1, 2, - - - 22 digit signals are connected to the head 22 so as to select the figure or digit of the selected character to be printed.

In the printing operation, upon issuance of the printing demand, the C.P.U. outputs to the C.S.D. and D.D, so that the motor 8 is driven and the selected character in the selected digit or figure number is determined thereby. The printing is effected during the digit signals 1 – 12 and the clutch magnet 16 is energized by the issuance of the digit signal 13 after the completion of the printing operation so as to actuate the clutch 7 for effecting the paper feeding upon disengagement of the head 22 from the platen 13, thus completing one cycle. The control circuit is so operated that the motor 3 is energized by digit signal simultaneously with the issuance of a printing demand by the printing demand circuit so as to speed up the motor 3 to its normal constant speed during the time the printing operation (digit signals 1–12) on the paper sandwiched between the platen 13 and the head 22 which are abutted each other is being effected by the printer, and the clutch magnet 16 is energized by the printing completion signal (digit signal 13 or 14) issued at the termination of the printing operation of a line of characters by the printing demand circuit for disengaging the clutch pawl 7*a* from the clutch so as to actuate the same and, shortly after the energization of the magnet 16, the magnet 16 is deenergized after the clutch 7 has commenced its actuation for permitting arresting of the driven member of the clutch 7 after one revolution thereof, thereby permitting the head-platen separating means including the levers 11 and the cams 9, 10 to be actuated so as to separate the platen 13 from the head 22 after the motor 3 reaches its normal constant speed while the paper feeding means including the cam 10*a*, lever 12 and the ratchet 17 is actuated after the platen 13 has been separated from the head 22, the motor being deenergized (by digit signal 22) after the completion of the actuation of the head-platen separating means and the paper feeding means.

Since the platen 13 is urged against the head 22 by the by the respective levers 11, 11 actuated by the respective springs 15, 15 independently from each other, the parallel relationship between the platen 13 and the head 22 in the longitudinal direction thereof is positively insured while the noise is extremely lowered by virtue of utilization of the motor 3 which is silent is operation and stopped after each cycle of printing operation and the time period for one cycle of the printing operation is reduced to the minimum because the speeding up of the motor to its constant speed is completed during the time the printing operation during which time the clutch 7 should not be actuated.

Further, since the platen 13 is rotatably supported about the longitudinal axis thereof, the parallel relationship between the platen 13 and the head 22, when the same are relatively moved in the direction perpendicular to the longitudinal axis of the platen 13 is also positively insured when they are abuted against each other for the printing operation thereby insuring the high quality of the printing.

Figure 5:
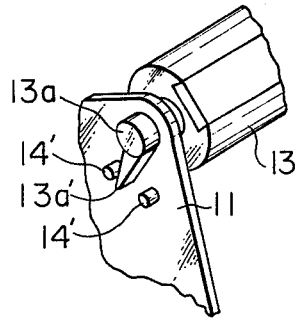
FIG. 5 is a fragmentary perspective view showing an alternative form of means for limiting the range of rotation of the platen and FIG. 6 is a schematic diagram of a conventional control circuit for actuating the drive motor and clutch magnet.

FIG. 5 shows an alternative form of the means for limiting the range of rotation of the platen 13 about the longitudinal axis thereof. In this case, a laterally extending arm 13*a'* is provided at the end of the shaft 13*a* of the platen 13 as shown in FIG. 5, and a pair of stopper pins 14', 14' are secured to the lever 11 at positions adjacent to the arm 13*a'* spaced each other. The arm 13*a'* is located between the pins 14', 14' so that the rotation of the arm 13*a'* of the shaft 13*a* and, hence, the platen 13 is limited by the pins 14', 14'.

In the embodiment as described above, the platen 13 is shown as being movably supported on the frame members while the head 22 is fixedly secured to the frame members. It is apparent, however, that the head 22 may be movably supported relative to the frame members while the platen is stationarily secured to the frame members allowing the rotation thereof about its longitudinal axis insofar as they are relatively moved toward and away from each other for effecting the printing operation as in the case of the embodiment described above.

Further, the head 22 may be rotatable about its longitudinal axis instead of allowing the platen to be rotated about its longitudinal axis in order to insure the parallel relationship between the platen and the head in the direction perpendicular to the longitudinal axis for obtaining the better quality of the printing.

I claim:

1. In a printer having a frame, a printing head and a platen, either one of said printing head and said platen being fixedly secured to said frame while the other is movably mounted on said frame by movable supporting means so as to move toward and away from said one of said printing head and said platen for the printing operation on a sheet held therebetween the improvement wherein said movable supporting means comprises:

a pair of supporting members each movably mounting said other of said printing head and said platen on said frame independently from each other at positions spaced from each other and about an axis parallel to the longitudinal axis of said other of said printing head and said platen;

each of said supporting members is biased by resilient means independently from each other so as to urge said other of said printing head and said platen toward said one of said printing head and said platen about said longitudinal axis and in a direction perpendicular to said longitudinal axis thereby insuring parallel relationship between said printing head and said platen when moved in said direction and about said axis into abutting relationship to each other;

means mounted upon said supporting members and operatively interconnected with additional means operatively formed with either one of said printing head and said platen, for controlling and limiting the range of rotation of said other one of said printing head and said platen;

said additional means for controlling and limiting the range of rotation of said platen comprises a peripheral groove formed in a shaft fixedly supporting said platen; and said means comprises a spring mounted on said frame with its one end supported stationarily on said frame while the other end is engaged in said peripheral groove in said shaft.

2. A thermal printer adapted to be operated by a printing demand generated therein for a printing operation and to issue a printing completion signal upon completion of the printing operation, said printer comprising:

a driving motor, a single revolution shaft driven by said driving motor through a single revolution clutch which is adapted to be rotated through a single revolution when actuated so that said shaft is rotated by one revolution each time said single revolution clutch is actuated, a clutch magnet for actuating said single revolution clutch, a control circuit for controlling the energization of said driving motor and said clutch magnet, a thermal printing head and a platen, said thermal printing head and said platen being normally urged in abutting relationship to each other for the printing operation, separating means operatively coupled with said single revolution shaft for releasing said abutting relationship between said thermal head and said platen so as to separate the same from each other during the time said single revolution shaft is being rotated through a single revolution, a paper feeding means operatively coupled with said single revolution shaft for feeding a paper held between said thermal head and said platen after said thermal head and said platen are held separated from each other while said single revolution shaft is being rotated through a single revolution, and means within sad control circuit for (1) energizing said driving motor simultaneously with the issuance of said printing demand in said printer so as to speed up said driving motor while the printing operation is being effected, (2) energizing said clutch magnet simultaneously with the inssuance of a printing completion signal so as to actuate said clutch for actuating said separating means and said paper feeding means in succession after the speed of said motor reaches its constant speed, and (3) deenergizing said motor after completion of the actuation of said separating means and said paper feeding means.

3. Thermal printer according to claim 2, wherein said separating means comprises a pair of swingable levers pivotally mounted on a printer frame and mounting thereon either one of said thermal head and said platen, and a pair of cam means provided on said single revolution shaft, each of said cam means cooperating with the respective lever so as to separate said one of said thermal head and said platen from the other by the rotation of said single revolution shaft upon issuance of said printing completion signal.

4. Thermal printer according to claim 2, wherein said paper feeding means comprises a ratchet secured to a paper feeding drum and a ratchet feeding pawl pivotally mounted on a lever which is swingably mounted on said printer frame, and said single revolution shaft is provided with a cam cooperating with said lever so that said ratchet is actuated by said pawl for feeding a paper when said lever is actuated by said cam by the rotation of said single revolution shaft upon issuance of said printing completion signal, the angular orientation of said cam being so selected that said lever is actuated by said cam after said thermal head and said platen are moved apart from each other.

5. In a printer having a frame, a printing head and a plate, either one of said printing head and said platen being fixedly secured to said frame while the other is movably mounted on said frame by movable supporting means so as to move toward and away from said one of said printing head and said platen for the printing operation on a sheet held therebetween the improvement wherein said movable supporting means comprises:

a pair of supporting members each movably mounting said other of said printing head and said platen on said frame independently from each other at positions spaced from each other and about an axis parallel to the longitudinal axis of said other of said printing head and said platen;

each of said supporting members is biased by resilient means independently from each other so as to urge said other of said printing head and said platen toward said one of said printing head and said platen about said longitudinal axis and in a direction perpendicular to said longitudinal axis thereby insuring parallel relationship between said printing head and said platen when moved in said direction and about said axis into abutting relationship to each other;

means mounted upon said supporting members and operatively interconnected with additional means operatively formed with either one of said printing head and said platen, for controlling and limiting the range of rotation of said other one of said printing head and said platen;

said additional means for controlling and limiting the range of rotation of said platen comprises an arm extending laterally from a shaft fixedly supporting said platen; and said means comprises a pair of stopper pins secured to said frame at positions spaced from each other, said arm being positioned between said pair of stopper pins.

* * * * *